United States Patent [19]

Reese

[11] Patent Number: 5,003,281

[45] Date of Patent: Mar. 26, 1991

[54] ELECTRICAL FUSE WITH SELF-CENTERING FUSE ELEMENT AND METHOD FOR MANUFACTURE THEREOF

[75] Inventor: Lloyd W. Reese, Centralia, Ill.

[73] Assignee: Littelfuse, Inc., Des Plaines, Ill.

[21] Appl. No.: 465,319

[22] Filed: Jan. 16, 1990

[51] Int. Cl.[5] ..... H01H 85/143; H01H 85/165

[52] U.S. Cl. ..... 337/252; 337/232; 337/248

[58] Field of Search ..... 337/252, 251, 232, 236, 337/260, 262, 248

[56] References Cited

U.S. PATENT DOCUMENTS

| | | | |
|---|---|---|---|
| 797,324 | 8/1905 | Sachs | 337/232 |
| 3,529,270 | 9/1970 | Kozacka | 337/232 |
| 4,159,458 | 6/1979 | Wiebe | 337/252 |
| 4,385,281 | 5/1983 | McAlear et al. | 337/186 |

FOREIGN PATENT DOCUMENTS

| | | | |
|---|---|---|---|
| 653114 | 11/1937 | Fed. Rep. of Germany | 337/248 |
| 8212 | of 1909 | United Kingdom | 337/252 |

*Primary Examiner*—H. Broome

*Attorney, Agent, or Firm*—Wallenstein, Wagner & Hattis, Ltd.

[57] ABSTRACT

A cylindrical cartridge-type fuse has terminal end caps configured to provide insertion-limiting shoulders arresting the movement of the insulating fuse housing sleeve into the caps during assembly, and further configured with solder-retaining wells having surfaces configured to aligningly guide an inserted fuse element into a generally central location when the sleeve and fuse element are forced into the cap with the solder in a molten condition. Accidental solder voiding arising from the displacement caused by the sleeve and the fuse element is eliminated, and a centered fuse element is provided, secured by an adequate mass of solder therearound. Additional mechanical strength is optionally imparted to the system by coating the finished structure with an adherent plastic or resin material.

18 Claims, 4 Drawing Sheets

ELECTRICAL FUSE WITH SELF-CENTERING FUSE ELEMENT AND METHOD FOR MANUFACTURE THEREOF

BACKGROUND OF THE INVENTION

In the manufacture of miniature electrical fuses having a generally centered fuse element within a cylindrical housing bore as distinguished from diagonally extending fuse elements, it is desirable that the element be reasonably well centered within the bore so that the fuses of a given type will have uniform blowing characteristics. A variety of well-known methods are used for centering fuse elements. In larger fuse structures, such methods include the use of perforated disks or plugs at either end of the housing bore provision of such plugs or disks adds to the cost of manufacture, and becomes increasingly difficult to implement as applied to fuses of extremely small dimension, such as cylindrical fuses having a housing length (body length) in the range of 5 mm. or so and having a corresponding bore diameter of the order of 1 mm.

An additional problem arises from the use of solder to attach the ends of the fuse element to the fuse terminal end caps. A preferred method of manufacture of, for example, cartridge-type cylindrical fuses is to provide a quantity of molten solder within a terminal forming end cap, to slide the cylindrical fuse housing into it, thereafter followed by the fuse element itself, after which the solder is fused to capture the end of the fuse in the cap. In the event that the end of housing itself is coated by a material which is wet by the solder, the solder will also adheringly capture the housing. A similar procedure is applied to secure the retaining ends of the housing and the fuse element to a second end cap. In the event that a housing material is employed which is not wet by the solder, the final structure may be encapsulated by an encapsulating resin by well-known methods, such as for example as set forth U.S. Pat. No. 4,385,281, issued May 24, 1983, to McAlear, et. al., the teachings of which are incorporated by reference herein.

The problem with such fabrication methods, although they are readily suited to mass-production, lies in the fact that a sufficient pool of solder must be provided in each cap to captively secure the fuse element ends, with the result that when the solder is melted and the housing and fuse element end are forced to a seated position within the end cap, it is frequently observed that a quantity of solder is splashed along the outer surface of the fuse housing body beyond the confines of the cap, requiring a subsequent solder removal operation. This undesirable exuding of solder is particularly noted when the second fuse cap is soldered to the structure, since the housing interior is now sealed, and gas venting augments this process. This problem is particularly objectionable in miniature fuses of dimensions as set forth above, since solder removal operations are extremely difficult with such small structures.

In addition to the problem of excess solder removal, a far more serious problem arises in conventional fuse designs because of the aforementioned gas venting, since in such designs such gas venting is observed on occasion to be sufficient to carry the entire volume of solder surrounding the fuse element completely away from it. A significant mass of solder should always remain emplaced around the fuse element to safely secure it to the interior surfaces of the fuse cap. A loss of this body frequently results in a fragile fuse structure.

The instant invention is oriented towards an inexpensive, reliable means of solving both of the aforementioned problems.

SUMMARY OF THE INVENTION

According to a feature of the invention as particularly applied to such miniature cartridge-type fuses having an axial fuse passage extending along a cylindrical housing, fuse end caps are provided having inwardly tapering guiding surfaces which urge the end of an inserted fuse element into a generally central location when the element is inserted under pressure through the molten solder mass. In a preferred embodiment such aligning surfaces are formed as conical or frusto-conical surfaces at the end of cylindrical housing-accepting end cap passages. By centering the fuse element at both ends it is held centered throughout the entire fuse passage, thus increasing the uniformity of the blowing characteristics of fuses of a given type.

According to a further feature of the invention, insertion-limiting shoulders are preferably provided within each end cap to limit the amount of movement of the fuse housing into the cap when the solder is melted. The residual volume between the shoulder-forming surfaces and the end of the cap forms a well, and by controlling the amount of solder placed in the end cap prior to assembly the displacement of the solder mass upon insertion of the fuse element and the fuse housing into the cap is insufficient to force solder beyond the cap ends. The well, however, is of sufficient depth to provide secure retention of the fuse element end. In the preferred form of the invention, the insertion-limiting shoulders are formed as an annular interior step within the terminal cap, and the remainder of the interior volume is of conical or frusto-conical form volume centering the fuse element as previously described, the volume outboard of the annular step forming the solder well. By providing the well so as to be located beyond the ends of the inserted fuse housing, whatever gas venting occurs on final soldering will occur between the well and the inserted housing portions, the venting gas traveling between the housing ends and the interior surfaces of the end cap with the result that, even if a measure of solder ejection does occur, that volume which was in the well remains in the well. Thus there is no loss of bonding integrity as in the case of the prior art structures discussed in the Background of the Invention.

According to method forms of the invention, as applied to cylindrical cartridge-type fuses having axial leads, the first end cap is placed face-up with a controlled quantity of solder pre-fused therein. The fuse element and housing are inserted and forced into the cap under light pressure, at which time the solder is re-melted until the housing slides into the well and into abutting confrontation with the shoulder portions and the end of the fuse element is centeringly slid into the well and into abutment with the interior cap face. The structure is then completed by emplacing a similar cap over the other end of the fuse, this second cap similarly having a pre-fused quantity of solder emplaced therein. A final melting operation with pressure applied to force the second cap over the housing causes the cap to slide along the structure until the previously mentioned abutting engagements occur. As mentioned in the "Background of Invention," in the event that the fuse housing is of non-wettable material, mechanical integrity may be imparted to the structure by the encapsulating the assembly by a suitable plastic or bonding resin.

Other features and advantages of the invention will be evident upon inspection of the drawings, specification and claims to follow.

DETAILED DESCRIPTION OF THE PREFERRED EMBODIMENT

Figure 5:
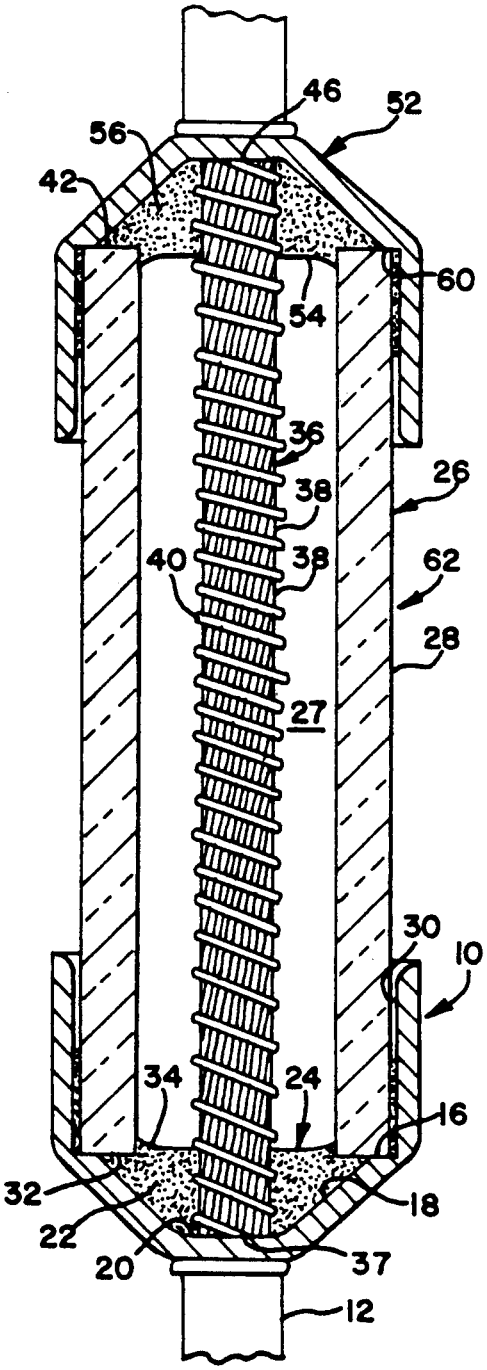
FIG. 5 shows the assembly of FIG. 4 after the melting of the solder in the upper end cap.
Figure 8B:
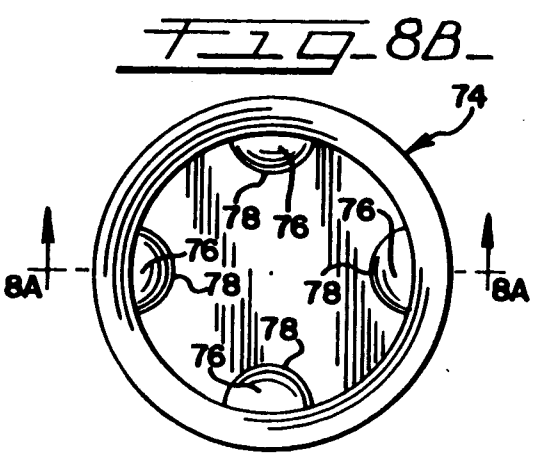
FIGS. 8A and 8B are cross-section and plan views respectively of a fourth version of end cap.
Figure 8A:
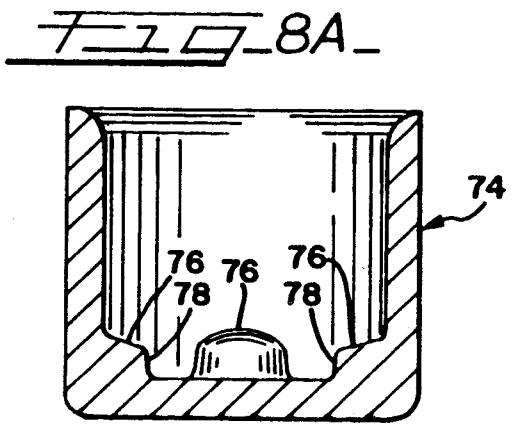
Figure 7B:
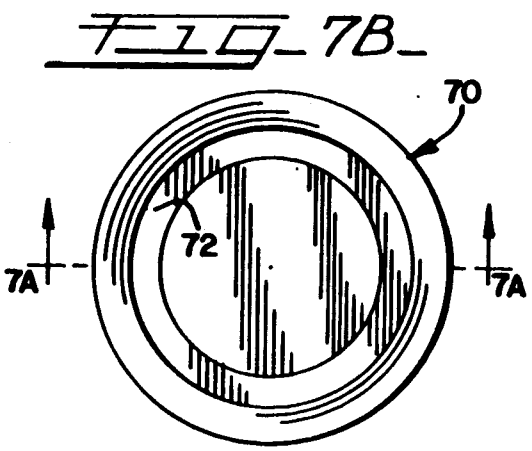
FIGS. 7A and 7B are cross-section and plan views respectively of a third version of end cap.
Figure 7A:
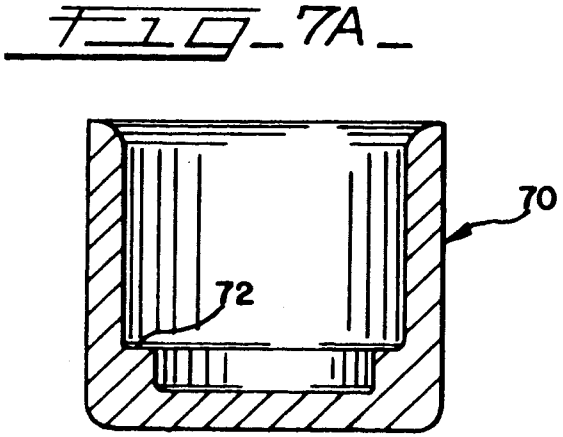
Figure 6B:
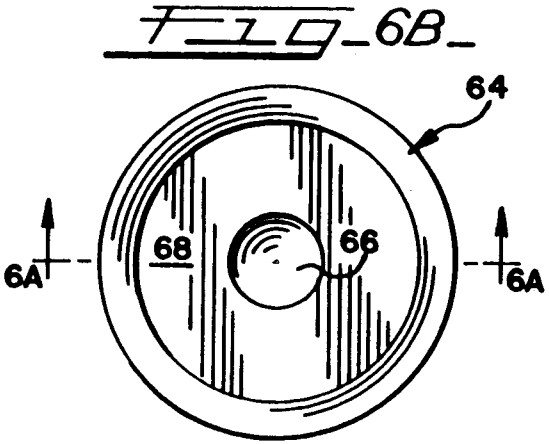
FIGS. 6A and 6B are cross-section and plan views respectively of a second version of end cap.
Figure 6A:
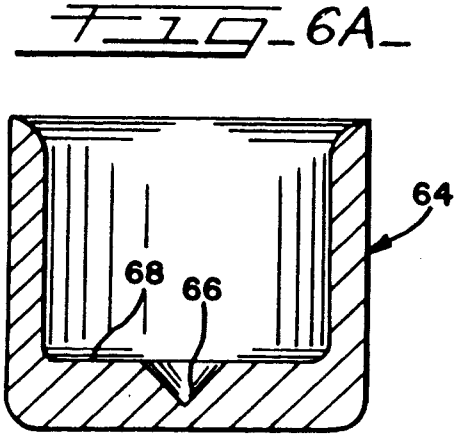
Figure 10B:
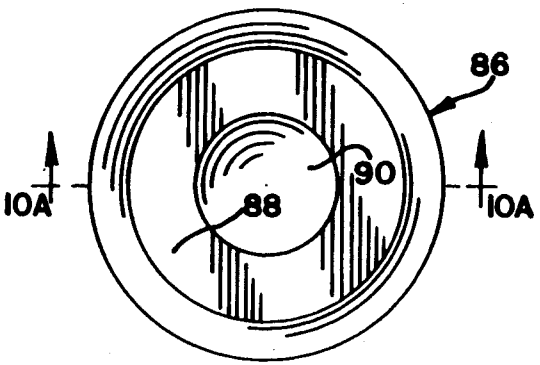
FIGS. 10A and 10B are cross-section and plan views respectively of a sixth version of end cap.
Figure 10A:
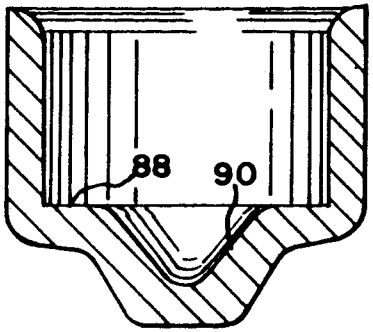
Figure 9B:
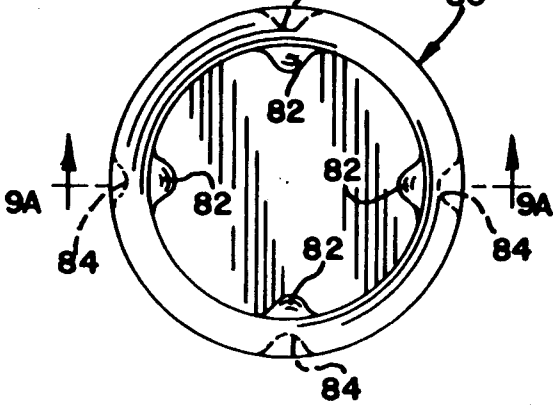
FIGS. 9A and 9B are cross-section and plan views respectively of a fifth version of end cap.
Figure 9A:
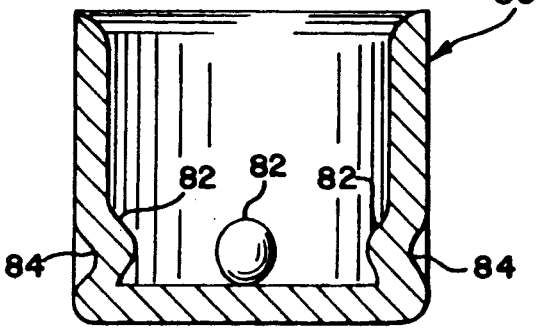

Referring now to the figures, FIG. 5 shows a fuse assembly 62 of the present invention. An insulating fuse housing 26 formed as a cylindrical sleeve of suitable insulating nature such as glass or ceramic having an axial passage 27 is captively secured at the lower end 32 thereof to an end cap 10 having an axial lead 12 affixed thereto. The end cap 10 has a frusto-conical outwardly extending interior wall 18 terminating in a planar interior end wall 20 to define a well 22 beyond the end 32 of the sleeve 26. In this well 22 the lower 37 of a fuse element assembly 36 disposing within the passage 27 is captively secured by a solder mass 24. An identical end cap 52 is emplaced over the upper end 42 of the sleeve 26 to secure the upper end 46 of the fuse element assembly 36 in a similarly configured well 56 by a similar solder mass 54. The configuration of the interior surfaces of the end caps 52, 10 exerts a generally centering element on the ends 46, 37 of the fuse element assembly 36 within the sleeve 26. As will be evidence from the method process to be subsequently described, the initial quantities of solder emplaced to form the solder masses 22, 56 are chosen such that when the end caps 10, 52 are emplaced and the solder masses melted, the insertion of the sleeve ends 32, 42 and fuse element ends 37, 46 thereinto causes only a modest displacement of the solder masses which is insufficient to cause solder splashing from end caps 10; however, because of the well-shaped volumes 22, 56 an adequate mass of solder surrounds the ends 37, 46 of the fuse element assembly 36 to anchor them securely. The resulting structure 62 may optionally be enclosed with an adherent plastic or resinous coating to impart additional axial strength to the structure.

Figure 1:
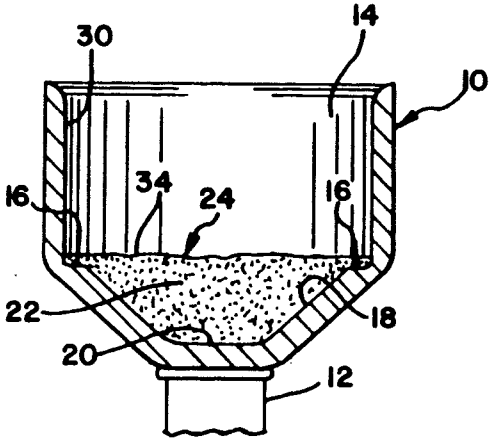
FIG. 1 is a partially cutaway view of a fuse end cap having a lead attached and a quantity of solder therein.

Considering next the steps of the manufacturing process, and referring now to the remaining figures, FIG. 1 shows the end cap 10 having the axially extending lead 12 attached thereto. The end cap 10 has a cylindrical passageway 14 terminating in the previously mentioned annular shoulder 16. A quantity of solder or other conducting bonding material 24 is disposed within the well 22, and is preferably pre-melted before the next phase of fuse assembly.

Figure 2:
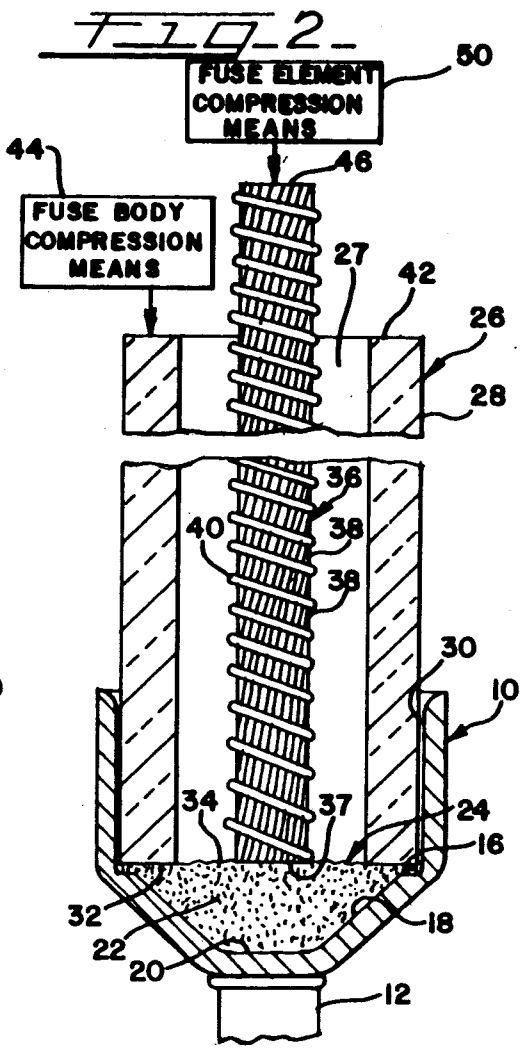
FIG. 2 is a view similar to FIG. 1 further showing a fuse body and fuse element pressed into engagement with the fuse cap.

The next step in assembly is shown in FIG. 2. The housing body has an outer wall 28 configured to be nestingly received by the inner wall 30 of the end cap 10, and is slid into the end cap 10 until the sleeve end 32 abuts the surface 34 of the solder mass 24. The fuse element assembly 36 is then inserted into the passage 27 of the sleeve 26 until its interior end 37 similarly abuts the surface 34 of the solder mass 24. The fuse element assembly 36 shown in FIG. 2 is of the form disclosed in U.S. Pat. No. 4,409,729, issued Oct. 10, 1983, to Shah, the teachings of which are incorporated herein by reference. This fuse element assembly 36 comprises a plurality of ceramic filaments 38 woven together and held in place by an external spiral of tinned fuse wire 40. Other forms of fuse element assemblies may equally well be employed in the practice of the instant invention.

Figure 3:
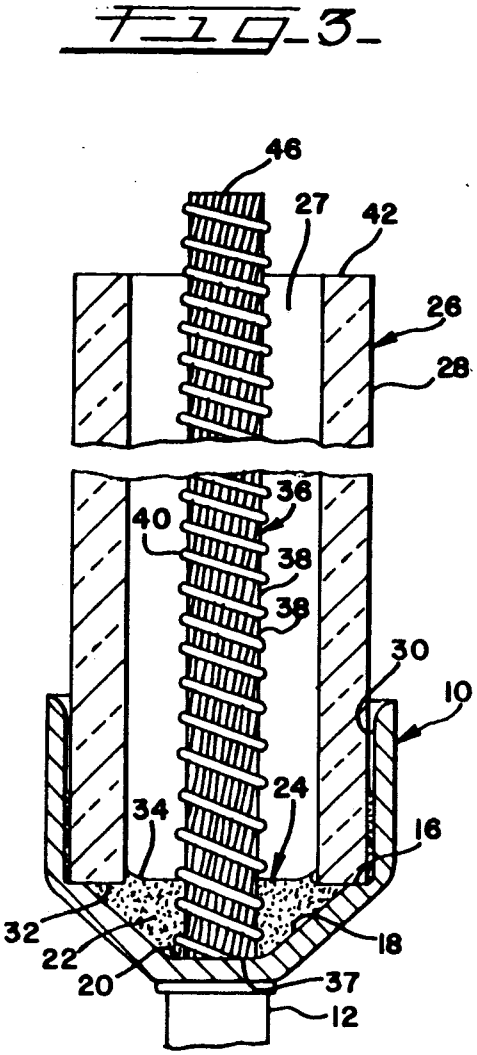
FIG. 3 shows the assembly of FIG. 2 after melting of the solder.

Before melting the solder mass 24, the entire assembly shown in FIG. 2 is preferably oriented to be in an upright position with the solder mass 24 at the bottom. A light axial force is applied to the upper end 42 of the sleeve 26 by means well known in the art and shown schematically in FIG. 2 as fuse body compression means 44. A similar force is applied to the upper end 46 of the fuse element assembly 36 by fuse element compression means 50. The solder mass 24 is then melted, whereupon the sleeve 26 is forced downward until its lower end 32 is arrestingly abutted by the shoulder 16 (FIG. 3). Similarly, the fuse element assembly 36 will move into the molten solder mass 24 until abuts the planar wall 20 of the end cap 10, the conical walls 18 having provided a generally centering action to the lower end 38 of the fuse element assembly 36. If desired, the planar wall 20 may be configured of smaller diameter to provide a higher degree of localizing action. The solder mass 24 is then cooled until it freezes.

It will be noted that the abutment of the shoulders 16 with the sleeve ends 32 effectively prevents substantial insertion of the sleeve 26 into the molten solder mass 24 from displacing a significant volume of solder upwards between the outer wall 28 of the sleeve 26 and the inner wall 30 of the end cap 10. A degree of such displacement of the molten solder mass 24 does occur because of the insertion of the end 38 of the fuse assembly 36; however, the quantity of solder pre-emplaced may be adjusted to compensate for this. It will thus be noted that at this point the lower end 38 of the fuse element 36 is now captively secured in a relatively massive well 22 of solder 24, thus securely affixing the lower end 38 of the fuse to the end cap 10.

Figure 4:
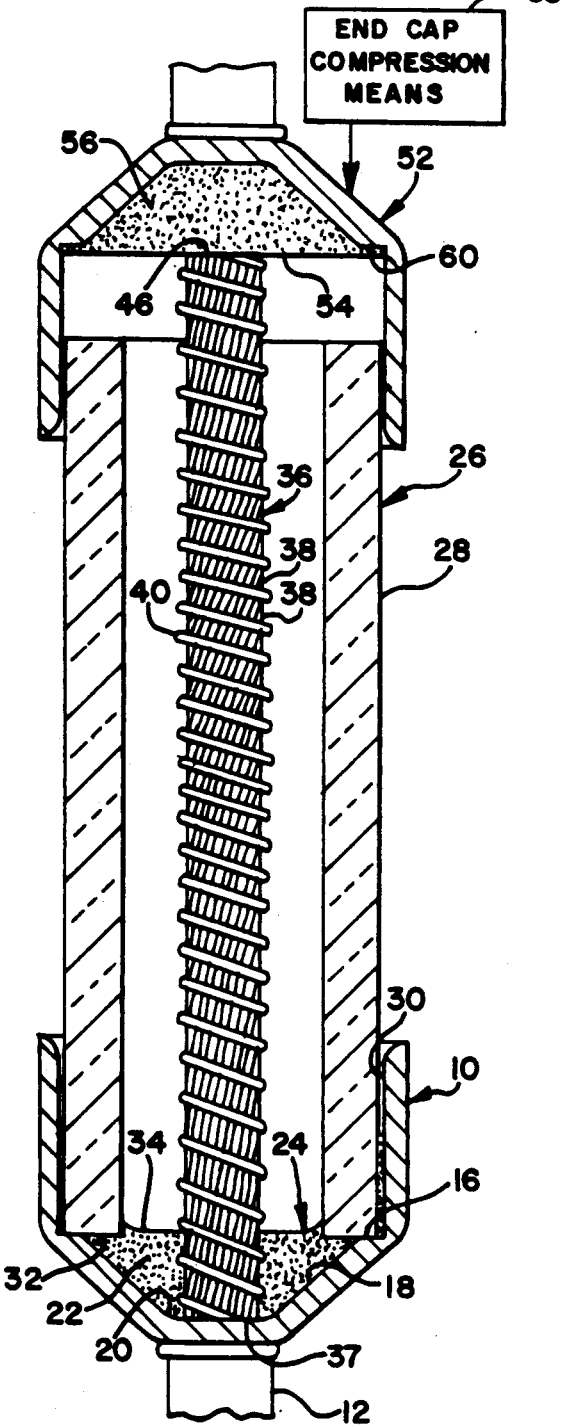
FIG. 4 shows the assembly of FIG. 3 with a cap similar to that of FIG. 1 compressingly emplaced on the other end of the structure.

FIG. 4 shows the next phase of assembly. The upper cap 52 is nestingly emplaced over the upper end 42 of the sleeve 26. Here the initial abutment occurs when the upper end 46 of the fuse element assembly 36 comes into contact with the surface 54 of the solder mass 56 in the upper cap 52. A light pressure is applied by end cap compression means 58 to urge the upper cap 52 downward along the sleeve 26. The solder mass 56 is then subject a rapid melting and cooling cycle. It will be noted that the end cap 52 is inverted during the melting process, and one would expect that the solder mass 56 would flow out of control down the structure; however, experience with miniature fuses having cap diameters of 3 mm. or so has shown that melting operations may be successfully performed with the assembly inverted and the solder mass 24 on top. This is believed to arise from surface tension effects in such small structures.

FIG. 5 shows the fuse assembly 62 after the second solder fusion. It will be noted that the top cap 52 has now dropped so that the upper end 42 of the sleeve 26 abuts the shoulder 60 of the top cap 52, with the upper end 46 of the fuse element assembly 36 centeringly captively secured in the upper solder mass 56.

In the event that the sleeve 26 has been end-coated with a material which can be adheringly wet by the solder masses 24, 56, the assembly operation may be terminated at this point. Since the sleeve 26 must be of electrically insulating material, this typically requires that there by local metalizations provided at the ends of the sleeve 26, which is an expensive procedure. Adequate short-term end cap adhesion can be provided by excess rosin adhering to the surface of the solder masses 24, 56 after initial pre-fusion. Such a residue typically remains, since the solder is preferably dispensed in wire form from solder dispensing spools, the solder having a conventional rosin core for fluxing purposes. A resulting small quantity of rosin will thus be left on the surface of the solder masses 24, 56. Upon final melting of each solder mass, a residual amount of this material will be adheringly emplaced between the sleeve outer surface 28 and the end caps 10, 52 after the end of each soldering operation. The adhesion of this material has proven to be sufficiently strong to allow the entire resulting structure 62 to be handled preparatory to affixing an adhesive encapsulating coating of plastic or resinous material over the completed assembly to yield the necessary final mechanical integrity, as for example by methods described in the previously mentioned U.S. Pat. No. 4,385,281.

FIGS. 6–10 show alternative versions of the end caps. FIGS. 6A and 6B show an end cap 64 having a conical well 66 of restricted dimension extending through a relatively large annular arresting shoulder 68. This structure will center a very small fuse element. FIGS. 7A and 7B show an end cap 70 having an annular abutment shoulder 72, but not providing a centering feature. FIGS. 8A and 8B show an alternative form of end cap 74 wherein the abutment shoulders are formed as upper surfaces 76 of a number of bosses 78 peripherally disposed about the bottom interior of the end cap 74. FIGS. 9A and 9B show another form of end cap 80 wherein abutment shoulders 82 are formed by local mechanical deformation of the metallic end cap to provide a number of peripherally disposed inwardly extending dimples 84. FIGS. 10A and 10B show another configuration of end cap 86 having a planar annular abutment shoulder 88 of dimension increased over that shown in FIG. 1, and having a more narrowly defined conical wall 90 for centering a fuse element. This latter configuration is closest to that shown in FIG. 1, and has proven to be cheaper to fabricate. The preferred material for the end cap 10 of FIG. 1 is an alloy of ten percent zinc and ninety percent copper.

While the specific embodiments have been illustrated and described, numerous modifications come to mind without significantly departing from the spirit of the invention and the scope of protection is only limited by the scope of the accompanying claims. Thus, it will be noted that the principles of the instant invention are not restricted to cylindrical cartridge-type fuses, but may be equally well employed with other types of fuses having at least one emplaceable end cap secured by solder requiring means for holding a fuse element end centered therein and wherein it is desirable not to have excess solder voided out-board of the structure during assembly. Additionally, the order of the steps of assembly of the fuse may be varied if desired. Thus, for example, the sleeve 26 and fuse element 36 need not be simultaneously soldered into the end cap 10; the sleeve may be so secured first, and the fuse assembly inserted and secured in a subsequent remelt operation. This alternative order of assembly, as well as other orders of assembly, are to be considered as within the scope of the claims.

We claim:

1. In an electrical fuse, a thin walled housing have a housing passage extending along a center axis therethrough and having first and second housing ends at least one of which is initially open to permit insertion of a fuse element thereinto while the other housing end is initially closed by an end cap, a fuse element disposed within said housing passage and spaced from the housing walls between the end portions thereof, first and second end caps engaging with and extending respectively around the outside of said housing ends and confronting the ends of said fuse element, said end caps including end walls having electrically conducting outer and inner surfaces for connection to an external circuit, and interconnection means for establishing electrical connection between both of said conducting surfaces of said end caps and the confronting ends of said fuse element, the improvement wherein at least the end wall of at least the end cap closing off said initially closed housing end having outwardly extending and tapering guiding inner wall surface extending towards said center axis to guide the confronting end of said fuse element towards said center axis during assembly of said fuse as it is inserted into the latter end cap.

2. The fuse of claim 1 wherein said interconnection means at the latter end cap includes a quantity of solder fused to the confronting fuse element end and the interior surface of said latter end cap.

3. The fuse of claim 1 wherein the end walls of both of said end caps have outwardly extending and tapering guiding inner wall surfaces extending toward said center axis to guide the confronting end of said fuse element towards said center axis during assembly of said fuse, and said interconnection means at both end caps includes a quantity of solder fused to the fuse element end confronting said second end wall and the interior surface of said second end wall.

4. The fuse of claim 2 wherein said housing is configured as a cylinder with said housing passage passing axially therethrough.

5. The fuse of claim 1, 2 or 3 wherein at least portions of each said guiding surface is configured as a conical surface converging away from said housing.

6. The fuse of claim 1 wherein said latter end cap forms a well beyond the adjacent end of said housing, said well containing a body of solder, said latter end cap having shoulder means inwardly of said well against which the adjacent end of said housing bears for limiting the extent of insertion of said housing end into said latter end cap to avoid splashing of solder as the adjacent housing end is inserted into said latter end cap passage with molten solder in said well during assembly of the fuse.

7. The fuse of claim 6 wherein said housing is configured as a cylinder with said housing passage passing axially therethrough, and said latter end cap having a cylindrical portion configured to accept insertion of the adjacent housing end and having said shoulder means disposed beyond said cylindrical portion.

8. The fuse of claim 4 wherein the other end cap is configured the same as said latter end cap and has an associated body of solder in the well thereof affixing the other end of said fuse element, each said end cap passage terminates in a conically formed region.

9. A method for making an electrical fuse comprising the steps of:

providing a thin-walled fuse housing having first and second opposite ends and a housing passage extending along a center axis between said housing passage ends;

providing a fuse element separate from said housing and having a diameter much less than and a length greater than said housing passage and at least one straight end;

providing a first end cap having a solder-receiving well in the outer portion thereof and shoulder means inwardly of said well against which an end of said housing is to bear when the housing is inserted into said end cap, said end cap having electrically conducting and interconnected inner and outer surfaces;

placing a first quantity of solder within said well of said first cap and melting said solder;

inserting said first housing end into said first end cap so as to bear against said shoulder means;

inserting said straight end of said fuse element into said housing passage and forcing said straight end thereof into said well where the solder is allowed to harden; and placing an end wall having electrically conducting interconnected inner and outer walls over said second end of said housing and securing said end wall to said housing and making electrical connection to the other end of said fuse element which is centered in and spaced from the housing walls between the ends thereof.

10. The fuse of claim 9 wherein said housing is configured as a cylinder with said housing passage passing axially therethrough, and said first end cap passage has a cylindrical portion configured to accept insertion of said first housing end and having said shoulder means disposed beyond said cylindrical portion.

11. The method of claim 10 wherein said cap passage has a reduced diameter along a terminal portion thereof to form an annular step providing said shoulder means.

12. The method of claim 11 including the steps of pre-melting said first quantity of solder into said first end cap before insertion thereinto of said first housing end.

13. The method of claim 12 including the step of applying a sufficient quantity of resinous flux attendant to said pre-melting step to form an excess thereof to yield an adherent bond between said first end cap and said housing end attendant to re-melting.

14. The method of claim 13 wherein said end wall is configured as a second cap identical to said first cap and both of said caps are made of electrically conducting material, said step of affixing said end wall includes providing a second quantity of solder within the cap passage of said second cap and inserting the opposite end of said housing into said cap passage of said second cap, said step of forming an electrical and mechanical connection includes applying a force urging said housing and said fuse element towards said second cap and melting said second quantity of solder until the inserted end of said housing abuts the shoulder means of said second cap and the proximal end of said fuse element enters the well of said second cap, said fuse element being chosen of a length to enter the well of said second cap, and further including the step of applying an adherent encapsulating layer to said housing and at least portions of each said cap.

15. The method for making an electrical fuse comprising the steps of:

providing a thin-walled fuse housing having first and second opposite ends and a housing passage extending along a center axis between said housing passage ends;

providing a fuse element separate from said housing and having a diameter much less than and a length greater than said housing passage and at least one straight end;

providing a first end cap having a cap passage extending partially thereinto, said first end cap having electrically conducting and interconnected inner and outer surfaces, the inner end of said cap passage having outwardly extending tapering guiding wall surfaces extending towards said center axis to guide the straight confronting end of an inserted fuse element towards said center axis during assembly of said fuse;

placing a first quantity of solder within said passage of said first cap and melting said solder;

inserting said first housing end into said first end cap;

inserting the straight end of said fuse element into said housing passage and forcing one end thereof into said cap passage of said first cap so as to be centered therein by said interior wall surfaces of said cap passage;

electrically and mechanically attaching said one end of said fuse element so centered to said first cap;

placing an end wall having electrically conducting interconnected inner and outer wall surfaces over said second end of said housing and securing said end wall to said housing and making electrical connection to the other end of said fuse element which is centered in and spaced from the housing walls between the ends thereof.

16. The method of claim 15 wherein said end wall is configured as a second end cap identical to said first cap, said first and second housing ends being of identical configuration, and including the steps of providing a quantity of solder within said cap passage of said second cap, inserting said second housing end into said cap passage of said second cap, applying a force urging said housing and said fuse element towards said second cap to center the proximal end of said fuse element by said guiding surfaces of said cap passage of said second end cap, said fuse element being chosen of a length sufficient to enter said second cap passage to be guided by said guiding surfaces of said second cap.

17. The method of claim 16 wherein said housing is configured as a cylinder with said housing passage passing axially therethrough.

18. The method of claim 17 wherein at least portions of said guiding surfaces are configured as conical surfaces converging in the outward direction away from said housing.

* * * * *